US005433160A

United States Patent [19]

Seki

[11] Patent Number: 5,433,160

[45] Date of Patent: Jul. 18, 1995

[54] SEWING MACHINE

[75] Inventor: Masayuki Seki, Nagoya, Japan

[73] Assignee: Brother Kogyo Kabushiki Kaisha, Nagoya, Japan

[21] Appl. No.: 176,573

[22] Filed: Dec. 30, 1993

[30] Foreign Application Priority Data

Jan. 19, 1993 [JP] Japan ..... 5-006713

[51] Int. Cl.[6] ..... D05B 65/02; D05B 69/18

[52] U.S. Cl. ..... 112/300; 112/317; 112/475.17

[58] Field of Search ..... 112/300, 317, 316, 453, 112/121.11, 445, 262.1

[56] References Cited

U.S. PATENT DOCUMENTS

| | | | |
|---|---|---|---|
| 4,080,914 | 3/1978 | Ishida et al. | 112/300 X |
| 4,147,119 | 4/1979 | Dunn | 112/121.11 X |
| 4,693,192 | 9/1987 | Yasui | 112/121.11 |
| 5,144,902 | 9/1992 | Hirabayashi | 112/300 X |
| 5,146,862 | 9/1992 | Sato et al. | 112/300 X |

*Primary Examiner*—Peter Nerbun
*Attorney, Agent, or Firm*—Nikaido, Marmelstein, Murray & Oram

[57] ABSTRACT

A sewing machine is provided with an automatic anti-loosening-stitcher mode selector switch for activating and deactivating the anti-loosening-stitcher mode in which anti-loosening-stitches are formed after the completion of a stitch pattern, and an automatic thread-cutter mode selector switch for activating and deactivating the thread-cutter mode in which threads are cut after the completion of a stitch pattern. When only the automatic thread-cutter mode selector switch is operated to set the thread-cutter activated mode, a CPU sets automatically both the anti-loosening-stitcher activated mode and the thread-cutter activated mode to form anti-loosening-stitches after the completion of a stitch pattern before cutting the threads so that stitches forming the end portion of the stitch pattern are prevented from loosening.

26 Claims, 6 Drawing Sheets

Fig. 3A
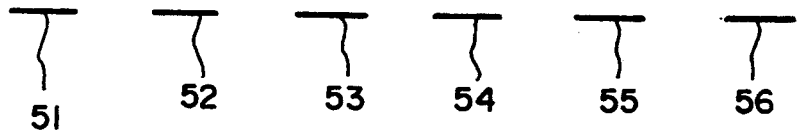
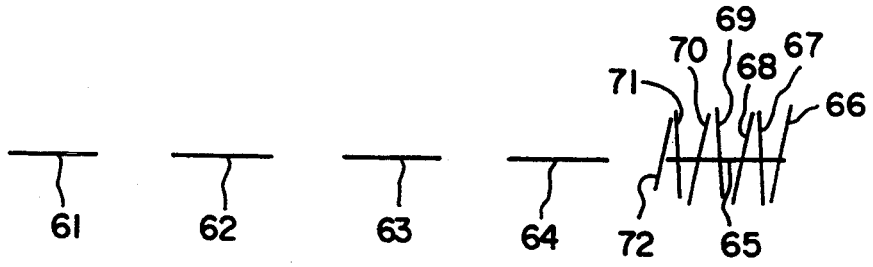
Fig. 3B
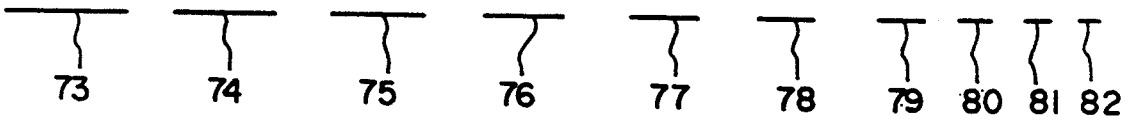
Fig. 3C

SEWING MACHINE

BACKGROUND OF THE INVENTION

1. Field of the Invention

The present invention relates to a sewing machine and, more particularly, to a sewing machine capable of automatically carrying out anti-loosening-stitching and thread-cutting.

2. Description of the Related Art

A known sewing machine capable of automatically carrying out back-stitching and thread-cutting after completing a stitch pattern is provided with an automatic back-stitching mode selector switch and an automatic thread-cutting mode selector switch respectively for setting the back-stitching activated mode and the thread-cutting activated mode. The automatic back-stitching mode selector switch and the automatic thread-cutting mode selector switch are operated to set the back-stitching activated mode and the thread-cutting activated mode and to cancel the same individually (i.e., to set the back-stitching deactivated mode and the thread-cutting deactivated mode). When the completion of a stitch pattern requires automatic back-stitching and automatic thread-cutting or when canceling the set back-stitching mode and the set thread-cutting mode, the automatic back-stitching mode selector switch and the automatic thread-cutting mode selector switch are operated accordingly to set the back-stitching activated mode and the thread-cutting activated mode or to set the back-stitching deactivated mode and the thread-cutting deactivated mode.

SUMMARY OF THE INVENTION

Generally, back-stitches are formed before cutting the threads to prevent the stitches of the stitch pattern from loosening after the threads have been cut. Therefore, the known sewing machine requires the operation of the two switches, i.e., the automatic back-stitcher mode selector switch and the automatic thread-cutter mode selector switch, to set the back-stitcher activated mode and the thread-cutter activated mode. If the operator fails to set the back-stitcher activated mode and sets only the thread-cutter activated mode, the stitches forming the stitch pattern will become loose after cutting the thread.

The present inventors recognized that it would be useful to provide a machine which can be set to a mode in which anti-loosening-stitching (e.g., back-stitching), defined below, is automatically and reliably performed before thread-cutting is performed, thereby avoiding operator failure and simplifying operation. Accordingly, the present invention provides a sewing machine capable of automatically setting the anti-loosening-stitcher activated mode when the thread-cutter activated mode is set.

A sewing machine in a first aspect of the present invention comprises an automatic anti-loosening-stitcher mode selector switch for setting the anti-loosening-stitcher activated mode, in which anti-loosening stitches are formed automatically after the completion of a stitch pattern, an automatic thread-cutter mode selector switch for setting the thread-cutter activated mode, in which threads are cut automatically after the completion of a stitch pattern, and a controller which sets the anti-loosening-stitcher activated mode when the automatic anti-loosening-stitcher mode selector switch is operated to set the anti-loosening-stitcher activated mode and which sets both the anti-loosening-stitcher activated mode and the thread-cutter activated mode when only the automatic thread-cutter mode selector switch is operated to set the thread-cutter activated mode (or when both the automatic anti-loosening-stitcher mode selector switch is operated to set the anti-loosening-stitcher activated mode and the automatic thread-cutter mode selector switch is operated to set the thread-cutter activated mode).

In this sewing machine, (1) the anti-loosening-stitcher activated mode, in which anti-loosening stitches are formed automatically after the completion of a stitch pattern, can be set by operating the automatic anti-loosening-stitcher mode selector switch, (2) the thread-cutter activated mode, in which threads are cut automatically after the completion of a stitch pattern can be set by operating the automatic thread-cutter mode selector switch, and (3) the controller sets only the anti-loosening-stitcher activated mode when the automatic anti-loosening-stitcher mode selector switch is operated to set the anti-loosening-stitcher activated mode and sets both the anti-loosening-stitcher activated mode and the thread-cutter activated mode when the automatic thread-cutter mode selector switch is operated to set the thread-cutter activated mode.

A sewing machine in a second aspect of the present invention comprises (1) an automatic anti-loosening-stitcher mode selector switch for setting the anti-loosening-stitcher activated mode, in which anti-loosening stitches are formed automatically after the completion of a stitch pattern, and for canceling the set anti-loosening-stitcher activated mode (i.e., for setting the anti-loosening-stitcher deactivated mode), (2) an automatic thread-cutter mode selector switch for setting the thread-cutter activated mode, in which threads are cut automatically after the completion of a stitch pattern, and for canceling the set thread-cutter activated mode (i.e., for setting the thread-cutter deactivated mode), and (3) a controller which cancels only the set thread-cutter activated mode when the automatic thread-cutter mode selector switch is operated to cancel the set thread-cutter activated mode in a state where both the anti-loosening-stitcher activated mode and the thread-cutter activated mode are set and which cancels both the anti-loosening-stitcher activated mode and the thread-cutter activated mode when the automatic anti-loosening-stitcher mode selector switch is operated to cancel the anti-loosening-stitcher activated mode in a state where both the anti-loosening-stitcher activated mode and the thread-cutter activated mode are set.

In this sewing machine, (1) the anti-loosening-stitcher activated mode, in which anti-loosening stitches are formed automatically after the completion of a stitch pattern, is set or canceled by operating the automatic anti-loosening-stitcher mode selector switch, (2) the thread-cutter activated mode, in which threads are cut automatically after the completion of a stitch pattern, is set or canceled by operating the automatic thread-cutter mode selector switch, (3) the controller sets only the thread-cutter deactivated mode when the automatic thread-cutter mode selector switch is operated to set the thread-cutter deactivated mode in a state where both the anti-loosening-stitcher activated mode and the thread-cutter activated mode are set, and the controller sets both the anti-loosening-stitcher deactivated mode and the thread-cutter deactivated mode when the automatic anti-loosening-stitcher mode selector switch is operated to set the anti-loosening-stitcher deactivated mode in a state where both the anti-loosening-stitcher activated mode and the thread-cutter activated mode are set.

Thus, the anti-loosening-stitcher activated mode is set necessarily when the thread-cutter activated mode is set to cut the threads automatically after the completion of a stitch pattern. Therefore, stitches of the stitch pattern do not become loose when the threads are cut automatically after the completion of the stitch pattern.

BRIEF DESCRIPTION OF THE DRAWINGS

The above and other objects, features and advantages of the present invention will become more apparent from the following description taken in connection with the accompanying drawings, in which:

FIGS. 3A, 3B and 3C depict anti-loosening stitch patterns.

DESCRIPTION OF THE PREFERRED EMBODIMENT

A sewing machine in a preferred embodiment is similar in construction to the conventional sewing machine of the same type and differs from the latter in an electric system incorporated therein and hence only the electric system of the sewing machine of the present invention needs to be described herein to describe the present invention.

Figure 1:
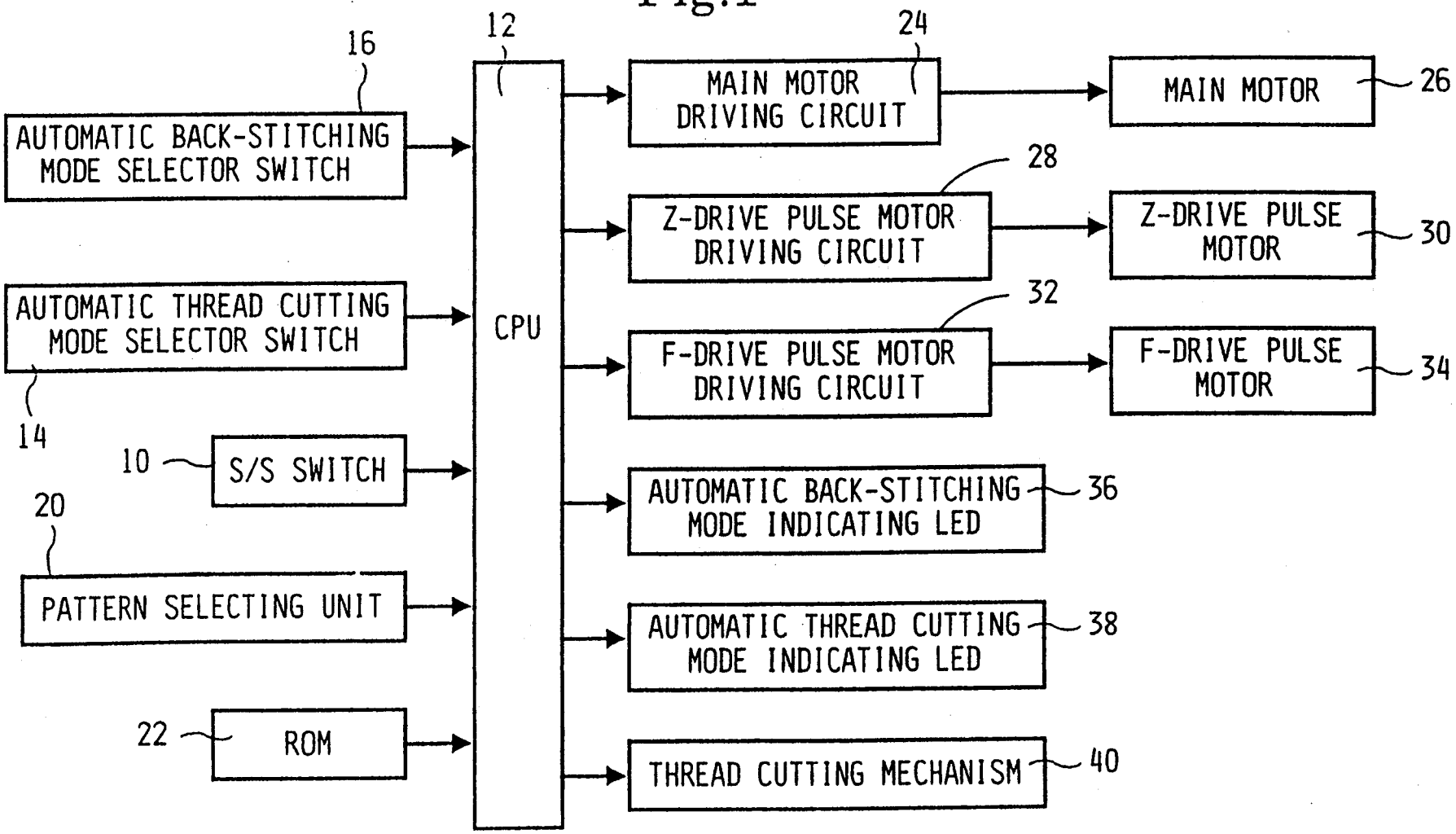
FIG. 1 is a block diagram showing the configuration of an electric system included in a sewing machine in a preferred embodiment according to the present invention.

Referring to FIG. 1, the electric system comprises, as principal components, a start/stop switch (hereinafter, referred to as the "S/S switch") 10, a central processing unit (hereinafter abbreviated "CPU") 12, an automatic thread-cutting mode selector switch 14, an automatic anti-loosening-stitching mode selector switch 16, a stitch pattern selecting unit 20, a ROM 22, a main motor driving circuit 24, a Z-drive pulse motor driving circuit 28, an F-drive pulse motor driving circuit 32, an automatic anti-loosening-stitching mode indicating LED 36, and an automatic thread-cutting mode indicating LED 38.

The sewing machine is provided with a thread-cutter 40 controlled by the CPU 12, a main motor 26 driven by the main motor driving circuit 24, a Z-drive pulse motor 30 driven by the Z-drive pulse motor driving circuit 28, and an F-drive pulse motor 34 driven by the F-drive pulse motor driving circuit 32.

A start signal or a stop signal provided by the S/S switch 10 is given to the CPU 12. When the automatic thread-cutting mode selector switch 14 is operated to set the thread-cutting activated mode, in which threads are cut automatically after the completion of a stitch pattern, an automatic thread-cutting activated mode setting signal is given to the CPU 12. When the automatic anti-loosening-stitching mode selector switch 16 is operated to set the anti-loosening-stitching activated mode, in which anti-loosening stitches are formed automatically after the completion of a stitch pattern, an automatic anti-loosening-stitching activated mode setting signal is given to the CPU 12. The pattern selecting unit 20 is operated to select a desired pattern from among a plurality of patterns and sends a pattern signal representing the selected pattern to the CPU 12. Pattern data of the patterns to be selected by the pattern selecting unit 20, and anti-loosening-stitch data are stored in the ROM 22. The CPU 12 carries out a control program, which will be described later, according to signals given thereto.

The main motor driving circuit 24 drives the main motor 26 according to instructions given thereto from the CPU 12. The main motor 26 drives the needle and the rotating hook device to form stitches on a workpiece. The Z-drive pulse motor driving circuit 28 drives the Z-drive pulse motor 30 according to instructions given thereto from the CPU 12 to swing the needle laterally, e.g., for zigzag stitching. The F-drive pulse motor driving circuit 32 drives the F-drive pulse motor 34 according to instructions given thereto from the CPU 12 to feed the workpiece. This assembly preferably also performs anti-loosening-stitching, and/or a separate similar assembly can be provided to perform anti-loosening stitching.

The expression "anti-loosening-stitch" is used herein to describe any type of stitch pattern which tends to avoid loosening of a thread, e.g., after the thread is cut. "Anti-loosening-stitch" includes back-stitching, reverse-stitching, bar-tacking and shortened-stitching. Back-stitching means that a stitch is repeated one or more times. A representative back-stitch pattern would be formed by stitching stitches 51 (see FIG. 3A), 52, 53, 54, and 55 once each in succession, and then stitching stitch 56 at least twice. Reverse stitching means that stitching is performed in one direction, and then it is performed in the opposite direction. Representative reverse stitching patterns would be formed by (1) stitching stitches 51, 52, 53, 54, 55, 56, 55, and 54 in succession, or (2) stitching stitches 51, 52, 53, 54, 55, 56, 55, 54, 55 and 56 in succession. Bar tacking means that a stitch is formed, and then stitches are formed which are perpendicular to that stitch and which cross over that stitch. A representative bar tacking stitch pattern would be formed by stitching stitches 61 (see FIG. 3B), 62, 63, 64, 65, 66, 67, 68, 69, 70, 71 and 72 in succession. Shortened stitching means that the length of successive stitches is decreased. A representative shortened stitch would be formed by stitching stitches 73 (see FIG. 3C), 74, 75, 76, 77, 78, 79, 80, 81 and 82 in succession.

When the anti-loosening-stitching activated mode is selected by the automatic anti-loosening-stitching mode selector switch 16, the automatic anti-loosening-stitching mode indicating LED 36 lights up to indicate the anti-loosening-stitching activated mode. When the thread-cutting activated mode is selected by the automatic thread-cutting mode selector switch 14, the automatic thread-cutting mode indicating LED 38 lights up to indicate the thread-cutting activated mode. The preferred thread-cutter 40 which cuts the needle thread and the bobbin thread is identical in construction and function with a thread-cutter described in the specification of U.S. Pat. No. 5,065,683 (the entirety of which is hereby incorporated herein by reference) of the assignee of the present patent application.

Figure 2A:
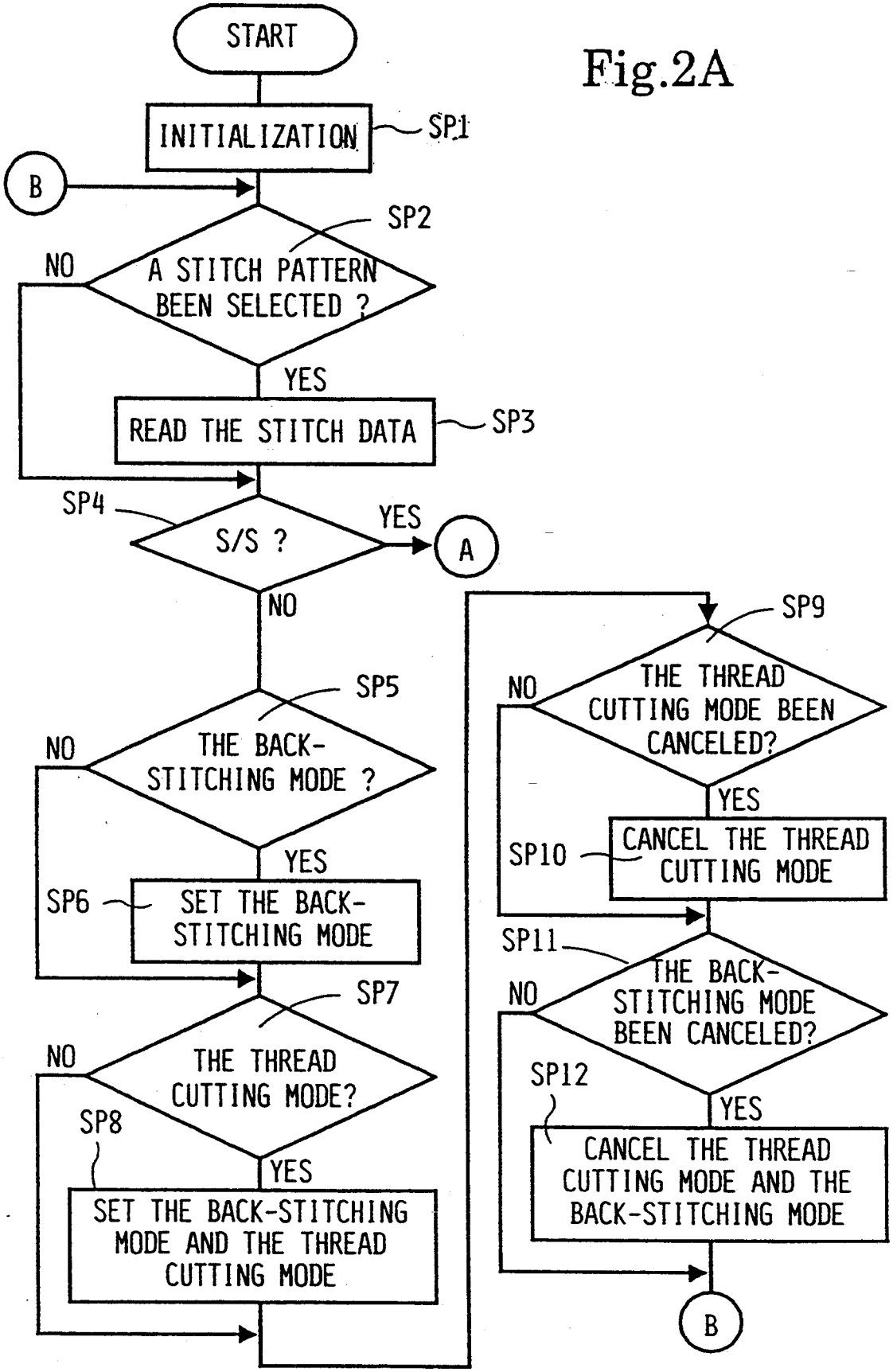
FIGS. 2A and 2B are flow charts of a control program to be carried out by a control unit included in the sewing machine of FIG. 1.
Figure 2B:
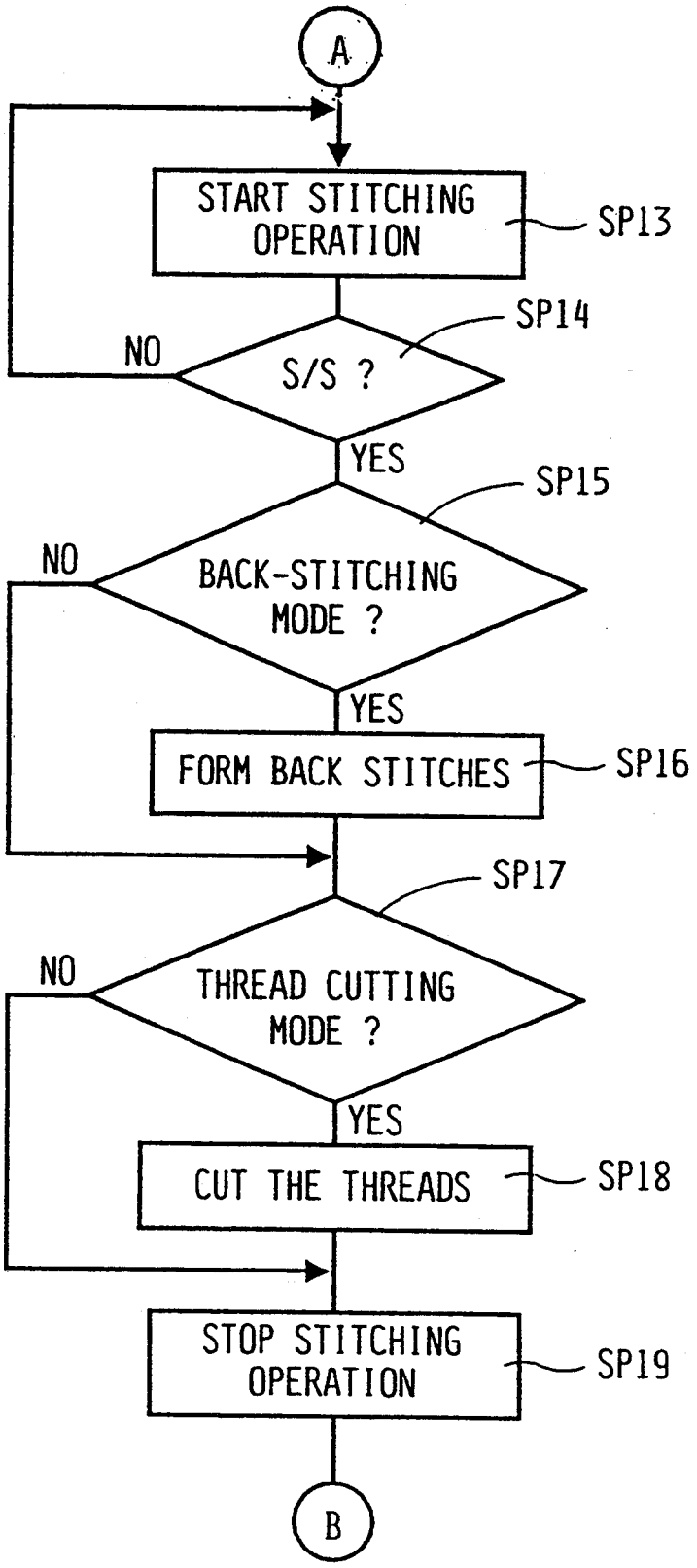
Figure 4:
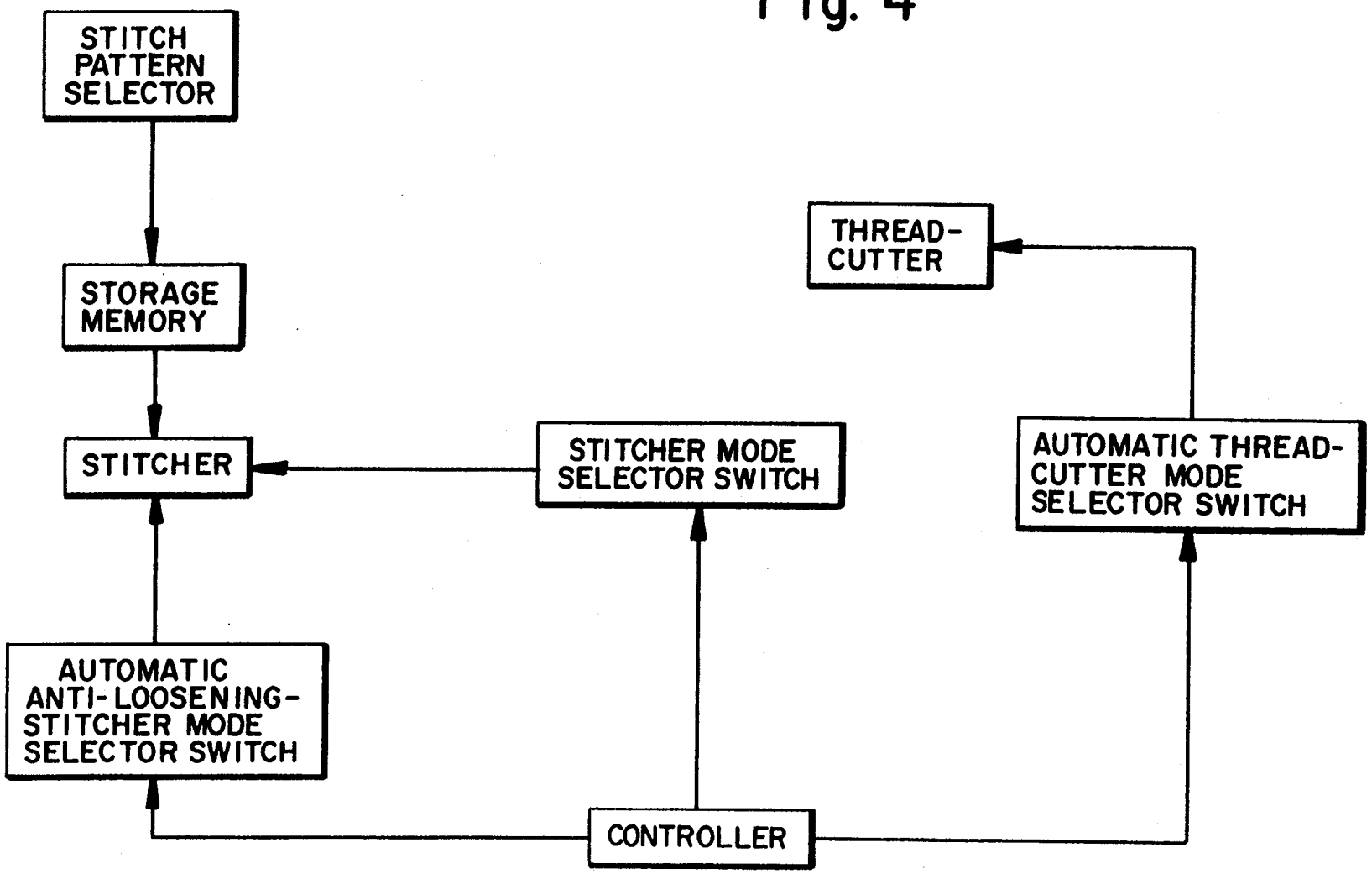
FIG. 4 is a block diagram of a sewing machine in accordance with the present invention.
Figure 5:
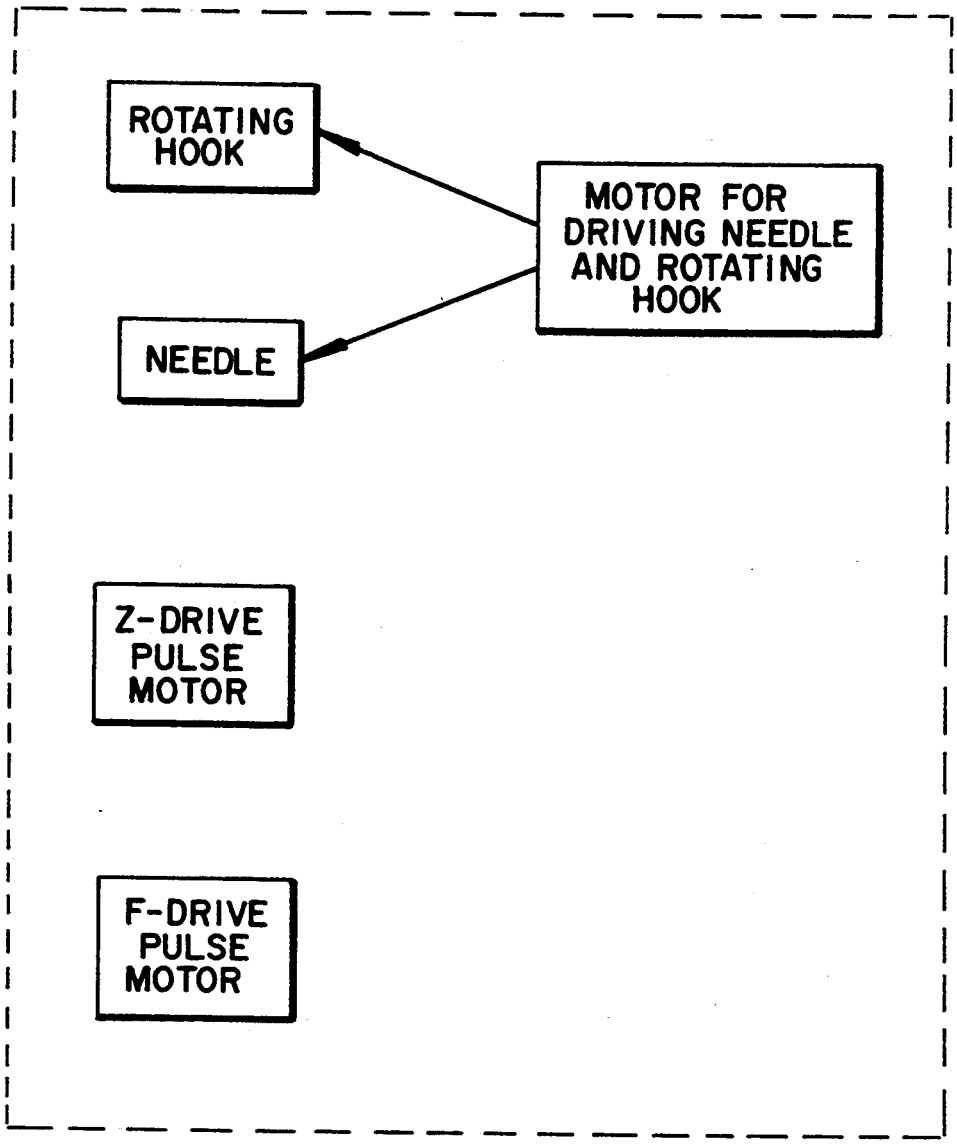
FIG. 5 is a block diagram of a stitcher according to the present invention.

Referring to FIG. 2, when the main switch is closed to connect the sewing machine to a power source, the CPU 12 executes step SP1 for initialization, in which the pulse motors 30 and 34 are adjusted to their starting positions, a straight stitch pattern is selected automatically and the anti-loosening-stitching mode and the thread-cutting mode are set to their deactivated modes. In step SP2, the CPU 12 makes a query to see if any stitch pattern is selected. If the response in step SP2 is affirmative, the CPU 12 reads pattern data of the selected stitch pattern from the ROM 22. In step SP4, the CPU 12 makes a query to see if the S/S switch 10 is operated to start sewing operation. If the response in step SP4 is negative, the CPU 12 makes a query in step SP5 to see if the automatic anti-loosening-stitching mode selecter switch 16 is operated to select the anti-loosening-stitching activated mode. If the response in step SP5 is affirmative, the CPU 12 sets the anti-loosening-stitching activated mode and turns on the automatic anti-loosening-stitching mode indicating LED 36 in step SP6. If the response in step SP5 is negative, step SP6 is skipped and step SP7 is executed.

In step SP7, the CPU 12 makes a query to see if the automatic thread-cutting mode selector switch 14 is operated to select the thread-cutting activated mode. If the response in step SP7 is affirmative, the CPU 12 sets both the thread-cutting activated mode and the anti-loosening-stitching activated mode and turns on the automatic thread-cutting mode indicating LED 38 and the automatic anti-loosening-stitching mode indicating LED 36 in step SP8 even if the anti-loosening-stitching activated mode is not selected in step SP6. Thus, both the thread-cutting mode and the anti-loosening-stitching mode are set in step SP8 when only the automatic thread-cutting mode selector switch 14 is operated to select the thread-cutting activated mode.

Operation for canceling the set thread-cutting activated mode and the set anti-loosening-stitching activated mode (i.e, for setting the thread-cutting deactivated mode and the anti-loosening-stitching deactivated mode) will be described hereinafter.

If the automatic thread-cutting mode selector switch 14 is operated to set the thread-cutting deactivated mode, the CPU 12 decides in step SP9 that an instruction to cancel the thread-cutting activated mode has been given and sets the thread-cutting deactivated mode and turns off the automatic thread-cutting mode indicating LED 38 in step SP10. If the response to the query in step SP9 is negative, step SP10 is skipped and step SP11 is executed. In step SP11, the CPU 12 makes a query to see if the automatic anti-loosening-stitching mode selector switch 16 has been operated to set the anti-loosening-stitching deactivated mode. If the response in step SP11 is affirmative, the CPU 12 sets both the anti-loosening-stitching deactivated mode and the thread-cutting deactivated mode and turns off both the automatic anti-loosening-stitching mode indicating LED 36 and the automatic thread-cutting mode indicating LED 38 in step SP12. Thus, the thread-cutting deactivated mode is set when the anti-loosening-stitching deactivated mode is set even if the automatic thread-cutting mode selector switch is not operated to set the thread-cutting deactivated mode in step SP10.

When stitching the selected stitch pattern, the S/S switch 10 is operated to start the stitching operation. Upon the detection of operation of the S/S switch 10 to start a stitching operation in step SP4, the CPU 12 executes step SP13 to drive the main motor 26, the Z-drive pulse motor 30 and the F-drive pulse motor 34 to stitch the selected stitch pattern.

In step SP14, the CPU 12 makes a query to see if the S/S switch 10 is operated to stop the sewing operation. If the response in step SP14 is affirmative, the CPU makes a query in step SP15 to see if the anti-loosening-stitching activated mode is set. If the response in step SP15 is affirmative, anti-loosening stitches are formed in step SP16. Then, the CPU 12 makes a query in step SP17 to see if the thread-cutting activated mode is set. If the response in step SP17 is affirmative, the CPU 12 controls the thread-cutter 40 to cut the threads, and then stops the sewing machine in step SP19.

Thus, the CPU 12 sets the thread-cutting activated mode and the anti-loosening-stitching activated mode simultaneously in step SP8 when only a signal requesting setting the thread-cutting activated mode is given thereto, and sets both the thread-cutting deactivated mode and the anti-loosening-stitching deactivated mode simultaneously in step SP12 when a signal requesting the setting of the anti-loosening-stitching deactivated mode is given thereto. Consequently, it is possible to obviate a state in which the threads are cut without forming anti-loosening-stitches after the completion of the stitch pattern and stitches forming the end portion of the stitch pattern loosen.

For the S/S switch 10, any device which can perform as discussed above can be employed. For the automatic anti-loosening-stitching mode selector switch 16 and the automatic thread-cutting mode selector switch 14, any devices which can perform as discussed above can be employed. As the stitcher, any device which can perform as discussed above can be employed. As the anti-loosening-stitcher, any device which can perform as discussed above can be employed. The stitcher and the anti-loosening-stitcher are preferably both contained in a single device, i.e., the device which performs stitching can be controlled so as to perform stitching and anti-loosening stitching. As the CPU 12, any device which can perform as described above can be employed. As the pattern selecting unit 20 and the ROM 22, any devices which can perform as described above can be employed.

In a third embodiment in accordance with the present invention, there is provided a sewing machine in which an automatic thread-cutting operation, followed by an anti-loosening-stitching operation are carried out before stitching is initiated. According to this modification, when the CPU determines that the S/S switch is operated to start the stitching operation, a thread-cutter automatically cuts the thread and then an anti-loosening-stitcher performs an anti-loosening-stitching operation before the stitching operation is started.

The aspects of any combinations of the first, second and third embodiments described above can be provided in a sewing machine in accordance with the present invention.

Although the invention has been described in its preferred forms with a certain degree of particularity, obviously many changes and variations are possible therein. It is therefore to be understood that the present invention may be practiced otherwise than as specifically described herein without departing from the scope and spirit thereof.

What is claimed is:

1. A sewing machine comprising:

a stitcher;

a stitcher mode selector switch having a stitcher activated position and a stitcher deactivated position, said stitcher performing stitching when said stitcher mode selector switch is in said stitcher activated position;

a thread-cutter;

an automatic thread-cutter mode selector, switch having an automatic thread-cutter activated position and an automatic thread-cutter deactivated position; and a controller for controlling said stitcher and said thread-cutter, wherein if said automatic thread-cutter mode selector switch is in said automatic thread-cutter activated position and said stitcher mode selector switch is switched from said stitcher activated position to said stitcher deactivated position, said stitcher stops stitching said thread, then said stitcher performs an anti-loosening-stitch pattern with said thread and then said thread-cutter cuts said thread.

2. The sewing machine according to claim 1, further comprising a storage memory which contains pattern data of at least one stitch pattern.

3. The sewing machine according to claim 2, wherein said storage memory stores pattern data of a plurality of stitch patterns, and said machine further comprises a stitch pattern selector which has a plurality of pattern selection positions for selection of one of said plurality of stitch patterns, such that when said stitcher mode selector switch is in said stitcher activated position, said stitcher stitches said thread according to said one of said plurality of stitch patterns.

4. The sewing machine according to claim 2, wherein said storage memory further contains pattern data of at least one anti-loosening-stitch pattern selected from the group consisting of back-stitching, reverse-stitching, bar-tacking and shortened-stitching.

5. The sewing machine according to claim 1, further comprising an automatic anti-loosening-stitcher mode selector switch which has an automatic anti-loosening-stitcher activated position and an automatic anti-loosening-stitcher deactivated position, and said controller controls said stitcher and said thread-cutter wherein, if said automatic anti-loosening-stitcher mode selector switch is in said automatic anti-loosening-stitcher activated position, and said automatic thread-cutter mode selector switch is in said automatic thread-cutter deactivated position, and said stitcher mode selector switch is switched from said stitcher activated position to said stitcher deactivated position, said stitcher stops stitching said thread, said stitcher performs an anti-loosening-stitch pattern with said thread and said thread-cutter does not cut said thread.

6. The sewing machine according to claim 5, wherein said controller also controls said thread-cutter and said stitcher mode selector switch, wherein if said automatic thread-cutter mode selector switch is in said automatic thread-cutter activated position and said automatic anti-loosening-stitcher mode selector switch is switched from said automatic anti-loosening-stitcher activated position to said automatic anti-loosening-stitcher deactivated position, said automatic thread-cutter mode selector switch is switched to said automatic thread-cutter deactivated position.

7. The sewing machine according to claim 5, further comprising an automatic anti-loosening-stitcher mode indicator which indicates when said automatic anti-loosening-stitcher mode selector switch is in said automatic anti-loosening-stitcher activated position, and an automatic thread-cutter mode indicator which indicates when said automatic thread-cutter mode selector switch is in said automatic thread-cutter activated position.

8. The sewing machine according to claim 7, wherein said automatic anti-loosening-stitcher mode indicator is an LED light and said automatic thread-cutter mode indicator is an LED light.

9. The sewing machine according to claim 1, wherein said stitcher comprises a needle, a rotating hook, a motor for driving the needle and the rotating hook, a Z-drive pulse motor and an F-drive pulse motor for performing said stitching and for performing said anti-loosening-stitch pattern.

10. The sewing machine according to claim 1, wherein said stitcher comprises a first needle, a first rotating hook, a first motor for driving the first needle and the first rotating hook, a first Z-drive pulse motor and a first F-drive pulse motor for performing said stitching and at least one member selected from a second needle, a second rotating hook, a second motor, a second Z-drive pulse motor and a second F-drive pulse motor for performing said anti-loosening-stitch pattern.

11. A sewing machine comprising:

a stitching means for stitching thread, said stitching means having a stitch activated mode, during which said stitching means stitches said thread, and a stitch deactivated mode, during which said stitching means does not stitch said thread;

a cutting means for cutting said thread;

an automatic thread-cutting mode selector switch means for switching said cutting means between an automatic thread-cutting activated mode and an automatic thread-cutting deactivated mode; and a controller means for controlling said cutting means and said stitching means, wherein if said cutting means is in said automatic thread-cutting activated mode and said stitching means is switched from said stitch activated mode to said stitch deactivated mode, said stitching means stops stitching said thread, then said stitching means performs anti-loosening-stitching with said thread and then said cutting means cuts said thread.

12. The sewing machine according to claim 11, further comprising a storage means for storing pattern data of at least one stitch pattern.

13. The sewing machine according to claim 12, wherein said storage means stores pattern data of a plurality of stitch patterns, and said machine further comprises a stitch pattern selector means which has a plurality of pattern selection positions for selecting one of said plurality of stitch patterns, such that when said stitching means is in said stitch activated mode, said stitching means stitches said thread according to said one of said plurality of stitch patterns.

14. The sewing machine according to claim 12, wherein said storage means further contains pattern data of at least one anti-loosening-stitch pattern selected from the group consisting of back-stitching, reverse-stitching, bar-tacking and shortened-stitching.

15. The sewing machine according to claim 11, further comprising an automatic anti-loosening-stitching mode selector switch means for switching said stitching means between an automatic anti-loosening-stitching activated mode and an automatic anti-loosening-stitching deactivated mode, wherein if said stitching means is in said automatic anti-loosening-stitching activated mode, and said cutting means is in said automatic thread-cutting deactivated mode, and said stitching means is switched from said stitch activated mode to said stitch deactivated mode, said stitching means stops stitching said thread, and said stitching means performs anti-loosening-stitching with said thread and said cutting means does not cut said thread.

16. The sewing machine according to claim 15, wherein said controller means also controls said cutting means and said stitching means wherein if said cutting means is in said automatic thread-cutting activated mode and said stitching means is switched from said automatic anti-loosening-stitching activated mode to said automatic anti-loosening-stitching deactivated mode, said cutting means is switched to said automatic thread-cutting deactivated mode.

17. The sewing machine according to claim 15, further comprising an automatic anti-loosening-stitching mode indicator means for indicating whether said stitching means is in said automatic anti-loosening-stitching activated mode, and an automatic thread-cutting mode indicator means for indicating whether said cutting means is in said automatic thread-cutting activated mode.

18. The sewing machine according to claim 17, wherein said automatic anti-loosening-stitching mode indicator means is an LED light and said automatic thread-cutting mode indicator means is an LED light.

19. The sewing machine according to claim 11, wherein said stitching means comprises a needle, a rotating hook, a motor for driving the needle and the rotating hook, a Z-drive pulse motor and an F-drive pulse motor for performing said stitching and for performing said anti-loosening-stitching.

20. The sewing machine according to claim 11, wherein said stitching means comprises a first needle, a first rotating hook, a first motor for driving said first needle and said first rotating hook, a first Z-drive pulse motor and a first F-drive pulse motor for performing said stitching, and at least one member selected from a second needle, a second rotating hook, a second motor, a second Z-drive pulse motor and a second F-drive pulse motor for performing said anti-loosening-stitching.

21. A method of sewing, comprising:

operating a stitcher switch to switch a stitcher to a stitcher activated mode in which thread is stitched by said stitcher;

switching an automatic thread-cutter mode selector switch to an automatic thread-cutter activated position, automatically switching an automatic anti-loosening-stitcher mode selector switch being to an automatic anti-loosening-stitcher activated position when said automatic thread-cutter mode selector switch is switched to said automatic thread-cutter activated position; and operating said stitcher switch to switch said stitcher to a stitcher deactivated mode, whereby said stitcher stops stitching said thread, then said automatic anti-loosening-stitcher activated position causes said stitcher automatically to perform anti-loosening-stitching with said thread, and then said automatic thread-cutter activated position causes a thread-cutter automatically to cut said thread.

22. The method according to claim 21, further comprising switching said automatic anti-loosening-stitcher mode selector switch to said automatic anti-loosening-stitcher activated position before said switching said automatic thread-cutter mode selector switch to said automatic thread-cutter activated position.

23. A method of sewing, comprising:

switching an automatic thread-cutter mode selector switch to an automatic thread-cutter activated position; and then switching an automatic anti-loosening-stitcher mode selector switch to an automatic anti-loosening-stitcher deactivated position, and automatically switching said automatic thread-cutter mode selector switch to an automatic thread-cutter deactivated position when said automatic anti-loosening-stitcher mode selector switch is switched to said automatic anti-loosening-stitcher deactivated position.

24. The method according to claim 23, further comprising switching a stitcher switch to a stitcher activated position in which thread is stitched by said stitcher before said switching said automatic anti-loosening-stitcher mode selector switch to said automatic anti-loosening-stitcher deactivated position, and then switching said stitcher switch to a stitcher deactivated position, whereby said stitching is stopped.

25. The method according to claim 23, further comprising switching said automatic thread-cutter mode selector switch to said automatic thread-cutter activated position after said switching said automatic anti-loosening-stitcher mode selector switch to said automatic anti-loosening-stitcher deactivated position, whereby said switching said automatic thread-cutter mode selector switch to said automatic thread-cutter activated position causes said automatic anti-loosening-stitcher mode selector switch to switch to an automatic anti-loosening-stitcher activated position.

26. A sewing machine comprising:

a stitcher;

a stitcher mode selector switch having a stitcher activated position and a stitcher deactivated position, said stitcher performing stitching when said stitcher mode selector switch is in said stitcher activated position;

a thread-cutter;

a controller which controls said stitcher and said thread-cutter wherein if said stitcher mode selector switch is switched from said stitcher deactivated position to said stitcher activated position, said thread-cutter cuts said thread, and then said stitcher performs an anti-loosening-stitch pattern with said thread before said stitcher stitches said thread.

* * * * *